US011430348B2

(12) United States Patent
Lubenschii

(10) Patent No.: US 11,430,348 B2
(45) Date of Patent: Aug. 30, 2022

(54) CABLE SEAL (VARIANTS) AND SEALING METHOD (VARIANTS)

(71) Applicant: Alexandr Lubenschii, Chisinau (MD)

(72) Inventor: Alexandr Lubenschii, Chisinau (MD)

( * ) Notice: Subject to any disclaimer, the term of this patent is extended or adjusted under 35 U.S.C. 154(b) by 360 days.

(21) Appl. No.: 16/474,577

(22) PCT Filed: Dec. 27, 2017

(86) PCT No.: PCT/MD2017/000008
§ 371 (c)(1),
(2) Date: Jun. 28, 2019

(87) PCT Pub. No.: WO2018/124870
PCT Pub. Date: Jul. 5, 2018

(65) Prior Publication Data

US 2021/0134189 A1 May 6, 2021

(30) Foreign Application Priority Data

Dec. 31, 2016 (MD) ..... 20160155

(51) Int. Cl.
*G09F 3/03* (2006.01)

(52) U.S. Cl.
CPC ..... *G09F 3/0352* (2013.01)

(58) Field of Classification Search
CPC ..... G09F 3/0352; G09F 3/03; G09F 3/0305; G09F 3/0323; G09F 3/0347;
(Continued)

(56) References Cited

U.S. PATENT DOCUMENTS 5,018,774 A * 5/1991 Rasmussen ..... F16G 11/048 24/129 R
5,114,196 A * 5/1992 Storer ..... G09F 3/0358 292/307 R (Continued)

FOREIGN PATENT DOCUMENTS

MD 3134 F1 8/2006
RU 16171 U1 12/2000

(Continued)

*Primary Examiner* — Alyson M Merlino
(74) *Attorney, Agent, or Firm* — Rumit R. Kanakia

(57) ABSTRACT

The invention relates to means for detecting unauthorized access to mobile and fixed warehouses and for protecting material assets stored therein against theft, and also for other similar purposes. A cable seal comprises a housing (1) containing a longitudinal blind axial channel (2) in which the end of a cable (3) is rigidly fastened, two axial channels (4) and (5) with locking mechanisms (6) and (7) for receiving the cable (3), and a loop A situated in the lower portion between channels (4) and (5). The loop A is protected by a mechanism which blocks access thereto, consisting of transverse channels provided in lateral ledges of the seal, said channels slidably receiving a bolt (10) with locking elements (11) mounted on an inner portion for engagement with a ledge (12) provided in the lower portion of the seal. According to a second variant of the cable seal, the mechanism which blocks access to the loop A consists of a covering plate (10), one end of which is hingedly fastened to a lateral ledge (11); the other end of the covering plate (10) has mounted thereon a mechanism which blocks access to the loop A, having an elastic element with a catch (12) that engages with a ledge (13).

6 Claims, 4 Drawing Sheets

(58) Field of Classification Search
CPC ..... E05B 67/365; E05B 73/0005; E05B 73/0017; E05B 73/0029; Y10T 292/14; Y10T 292/34; Y10T 292/48; Y10T 292/491; Y10T 292/497; Y10T 292/199; Y10T 292/198; Y10T 292/507; Y10T 292/509; Y10T 292/513; Y10T 292/516; Y10T 292/528; Y10T 24/3993; Y10T 24/3996; Y10T 24/3969; Y10T 24/3976; Y10T 24/3984; Y10T 24/3987; Y10T 292/307; F16G 11/108; F16G 11/105; F16G 11/04; F16G 11/048
See application file for complete search history.

(56) References Cited

U.S. PATENT DOCUMENTS

| | | | | | |
|---|---|---|---|---|---|
| 5,762,386 | A * | 6/1998 | Fuehrer | G09F 3/0352 292/307 R |
| 5,784,764 | A * | 7/1998 | Djordjevic | F16L 3/08 24/19 |
| 5,788,294 | A * | 8/1998 | Leon | G09F 3/0358 292/307 R |
| 2006/0290147 | A1 | 12/2006 | Liroff | |
| 2015/0143717 | A1 | 5/2015 | Billings | |
| 2017/0178546 | A1 * | 6/2017 | Kleynerman | G09F 3/0352 |

FOREIGN PATENT DOCUMENTS

| | | | | |
|---|---|---|---|---|
| WO | WO-0016296 | A1 * | 3/2000 | G09F 3/0352 |
| WO | WO-2005086121 | A1 * | 9/2005 | G09F 3/0352 |
| WO | WO-2006085735 | A1 * | 8/2006 | G09F 3/0352 |
| WO | WO-2006137722 | A1 * | 12/2006 | G09F 3/0352 |

* cited by examiner

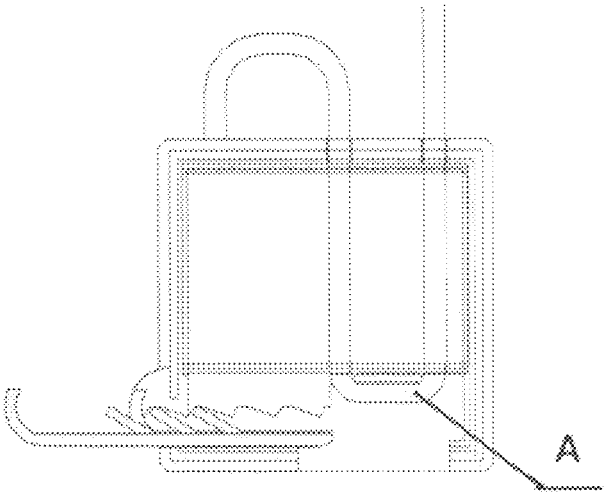
FIG. 1.1
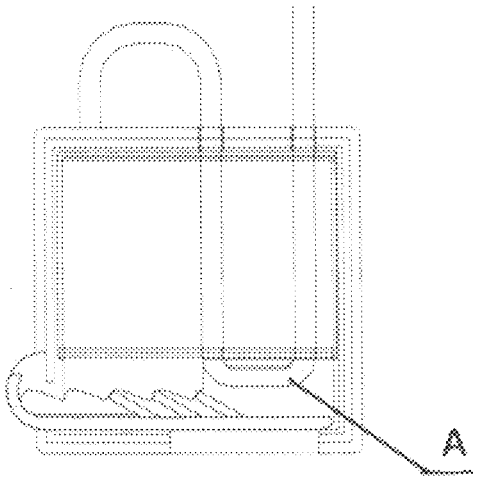
FIG. 1.2
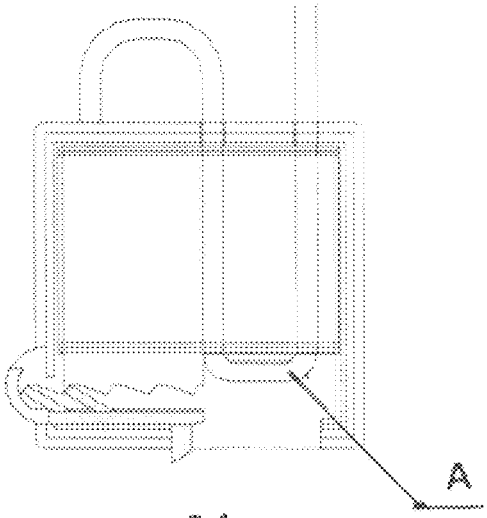
FIG. 2.1
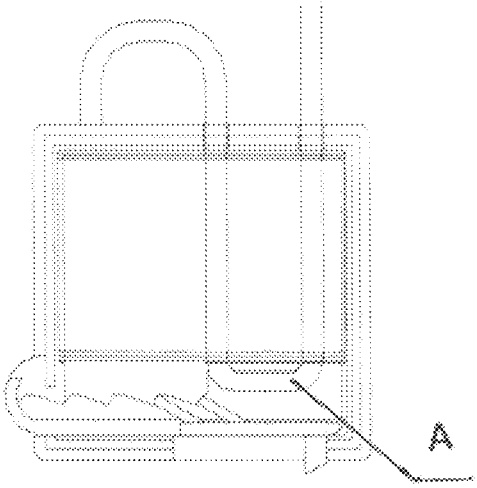
FIG. 2.2
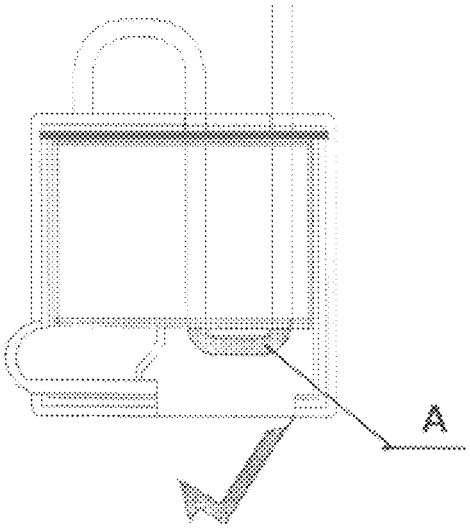
FIG. 3.1
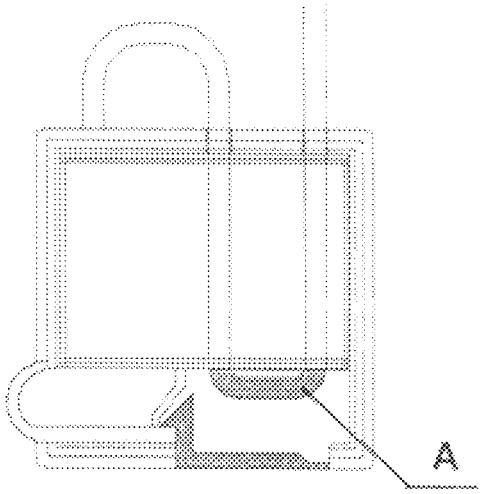
FIG. 3.2

CABLE SEAL (VARIANTS) AND SEALING METHOD (VARIANTS)

TECHNICAL FIELD

The invention relates to the means for detecting an unauthorized access to mobile and stationary warehouses, protection against theft of material assets stored therein as well as for other similar purposes.

BACKGROUND

There exists a seal protected by a cable in the housing of which there is a solid channel on one side where the end of the cable is encapsulated. Hereafter, as a result of blocking (sealing) of the product, the other end of the cable is passed through the inner portion of the second and third channels of the housing, equipped with locking mechanisms. After blocking of the cable, extended through the second and third channels of the housing the cable is placed in the lower portion of the housing of the seal forming a visually available loop (1) MD 3134 F1 2006.08.31.

Basing on the analysis of the practice of use of the seals protected by a cable and having two parallel locking mechanisms it was established that a disadvantage of such a design consisted in a possibility of pulling out of the cable by extrusion or by twisting it in and out of the locking mechanisms of a seal, to strengthen the contraction of a loop of the cable hidden inside the housing of the seal or laid on the housing. Basing on the above actions the diameter of the loop may be increased, significantly protruding beyond the perimeter of the seal. After increasing the size of the cable loop, having the intention to break the seal, the cable loop is stretched with special tools and attempts to pull the cable out of the seal are made. This design defect of the solid seal challenges the possibility of its use for sealing the items that require an increased level of reliability and property safety.

The problem this invention solves is to increase the sealing reliability providing an increased safety of material values.

SUMMARY

The LOCKIN cable seal includes a housing with a longitudinal blind axial channel where the end of the cable is securely fixed and two axial channels with locking mechanisms to locate the cable inside. In the lower portion of the seal, between the axial channels, a loop is formed, protected by the side ledge of the seal. In the lower portion of the housing of the seal a mechanism is mounted that blocks the access to the loop, consisting of transverse channels made on the side ledge of the seal, where a sliding bolt with the locking elements is mounted which interlocks with the ledge available on the lower portion of the seal.

The cable seal where the locking elements are mounted on the inner portion of the bolt in the form of elastic arms in an indefinite number, arranged symmetrically, in the form of a fish bone.

The cable seal where the locking elements are mounted on the inner portion of the bolt in the two elastic arms arranged symmetrically whereas the lower portion of the bolt has a ledge.

The cable seal includes a housing with a longitudinal blind axial channel where the end of the cable is securely fixed and two axial channels with locking mechanisms to locate the cable inside. In the lower portion of the seal, between the axial channels, a loop is formed, protected by the side ledge of the seal. In the lower portion of the housing of the seal, a mechanism is mounted that blocks the access to the loop, consisting of a covering plate, one end of which is hingedly fixed by a side ledge, while at the second end of the covering plate a mechanism is mounted that blocks the access to the loop, consisting of an elastic element with a catch connected to the ledge available at the bottom of the seal.

The method of protection using a cable seal consists in a secure fastening of the cable end into the longitudinal blind axial channel of the seal while the second end of the cable is extended through the lugs of the object to be sealed and then extended through the axial channels with locking mechanisms forming a loop at the bottom of the seal between the axial channels. Blocking the only access to the loop of the seal cable is performed by pressing the extended bolt which, sliding along the transverse channels available on the lateral ledge of the seal, fixes due to its blocking elements mounted on the inner portion coupling with the ledge available on the lower portion of the seal, thus leaving no option for a subsequent unlocking of the bolt.

The protection method using a cable seal consists in a secure fastening of the cable end in the longitudinal blind axial channel of the seal whereas the second end of the cable is extended through the lugs of the object to be sealed; then, it should be extended through the axial channels with locking mechanisms, forming a loop at the bottom of the seal between the axial channels protected by the side ledge of the seal. Blocking the only access to the loop of the seal cable is performed by affecting the ledge available in the lower portion of the bolt which, sliding with its locking elements mounted on its inner portion, blocks the bolt leaving no option for its subsequent unlocking.

The protection method using a cable seal consists in secure fastening of the cable end in the longitudinal blind axial channel of the seal whereas the second end of the cable is extended through the lugs of the object to be sealed; then, it should be extended through the axial channels with locking mechanisms, forming a loop at the bottom of the seal between the axial channels protected by the side ledge of the seal. Blocking the only access to the cable loop of the seal is performed by affecting the covering plate until the catch of the covering plate is connected in the ledge of the mechanism blocking the access to the loop.

The technical result of the invention consists in the method of mandatory sealing and blocking of that portion of the cable seal where the cable loop is formed between the two channels where the locking mechanism of the sealing device is mounted.

This method of security provision with the help of this invention significantly increases the reliability of a cable seal.

BRIEF DESCRIPTION OF DRAWINGS

The invention is presented on the schemes: FIG. 1-6, presenting:

FIG. 1.1—the cable seal with the bolt with the blocking elements in the rest position, in section;

FIG. 1.2—the cable seal with the bolt with blocking elements in the blocked position, in section;

FIG. 2.1—the cable seal with the bolt with blocking elements in the rest position, in section:

FIG. 2.2—the cable seal with the bolt with blocking elements in the blocked position, in section;

FIG. 3.1—the cable seal with the covering plate with the catch and ledge in the rest position, in section;

FIG. 3.2—the cable seal with the covering plate with the catch and ledge in the blocked position, in section;

FIG. 4—the cable seal with a bolt, general view, in section;

FIG. 5—the cable seal with a bolt with a ledge at the bottom, general view, in section;

FIG. 6—the cable seal with the covering plate, general view, in section.

DESCRIPTION

Figure 4:
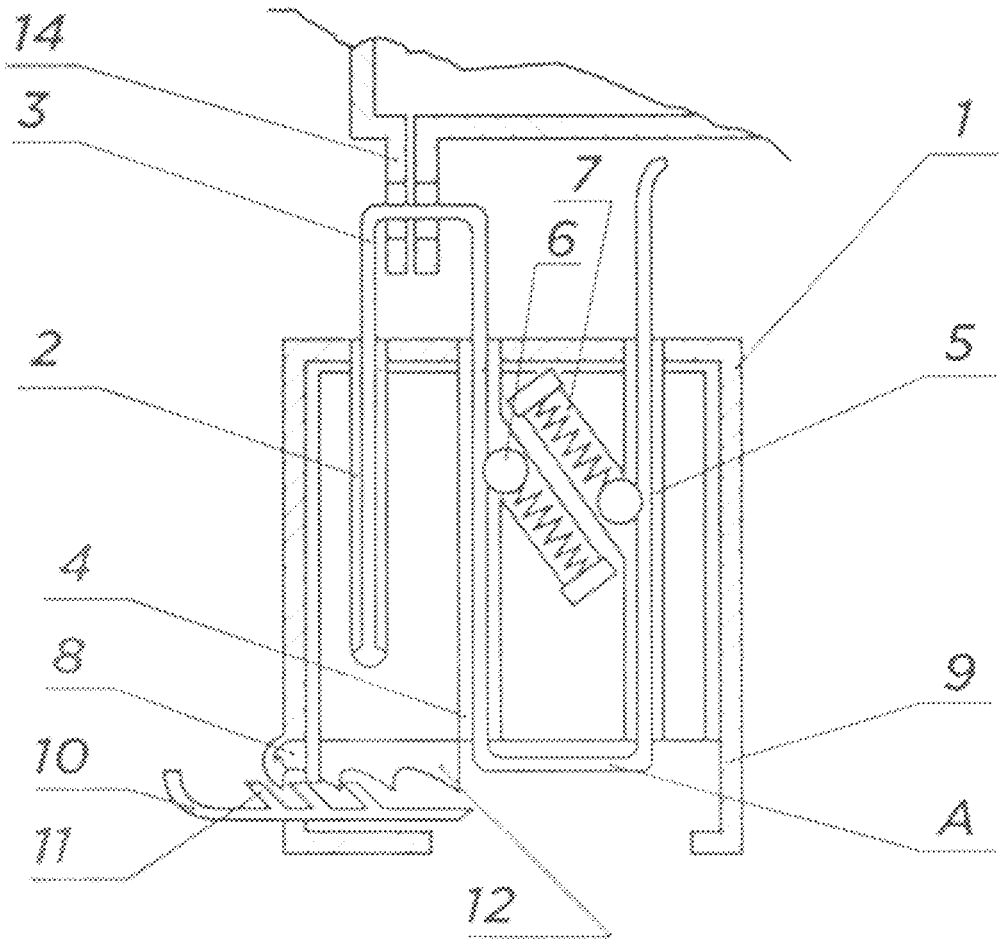
Figure 5:
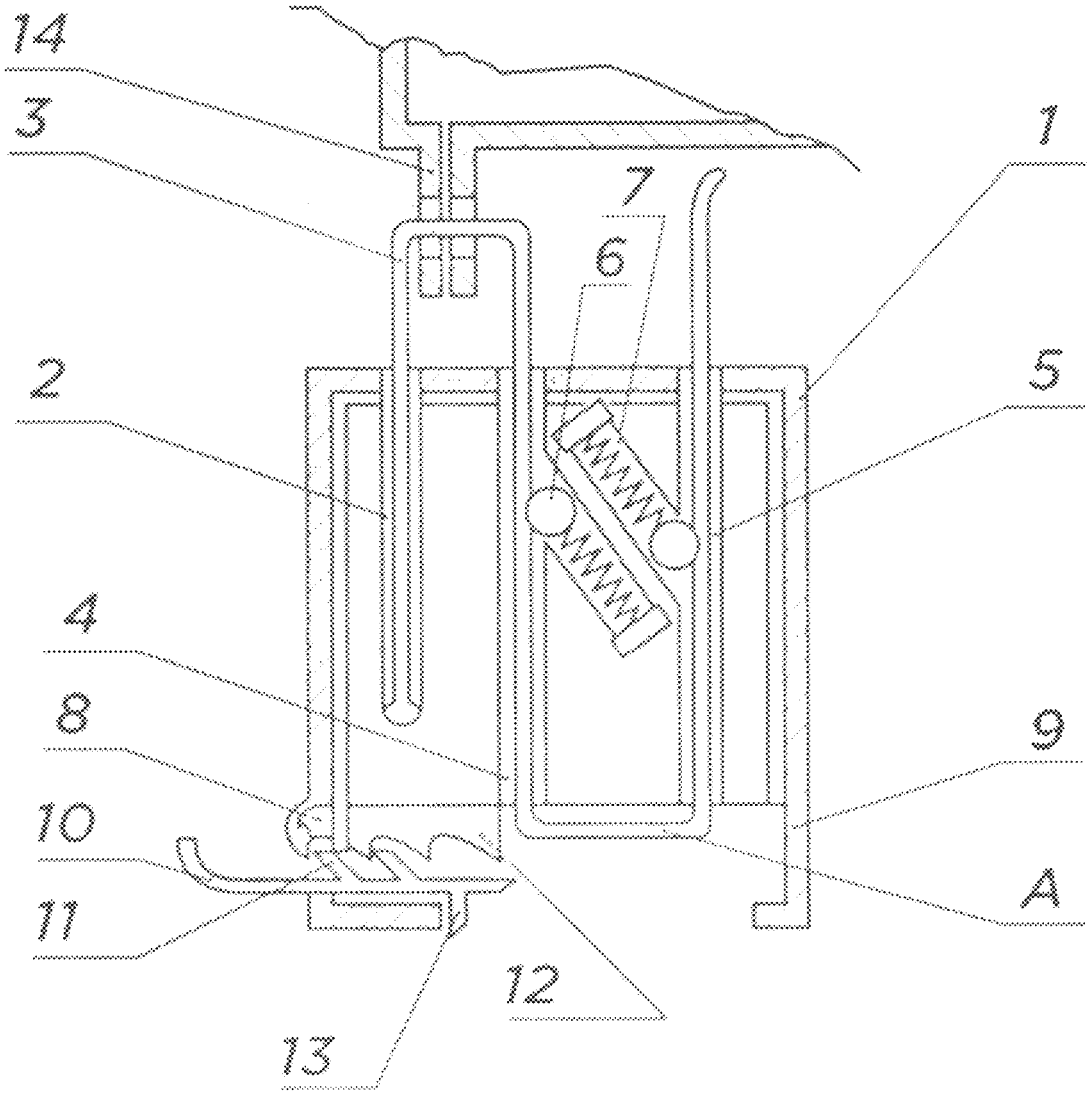
Figure 6:
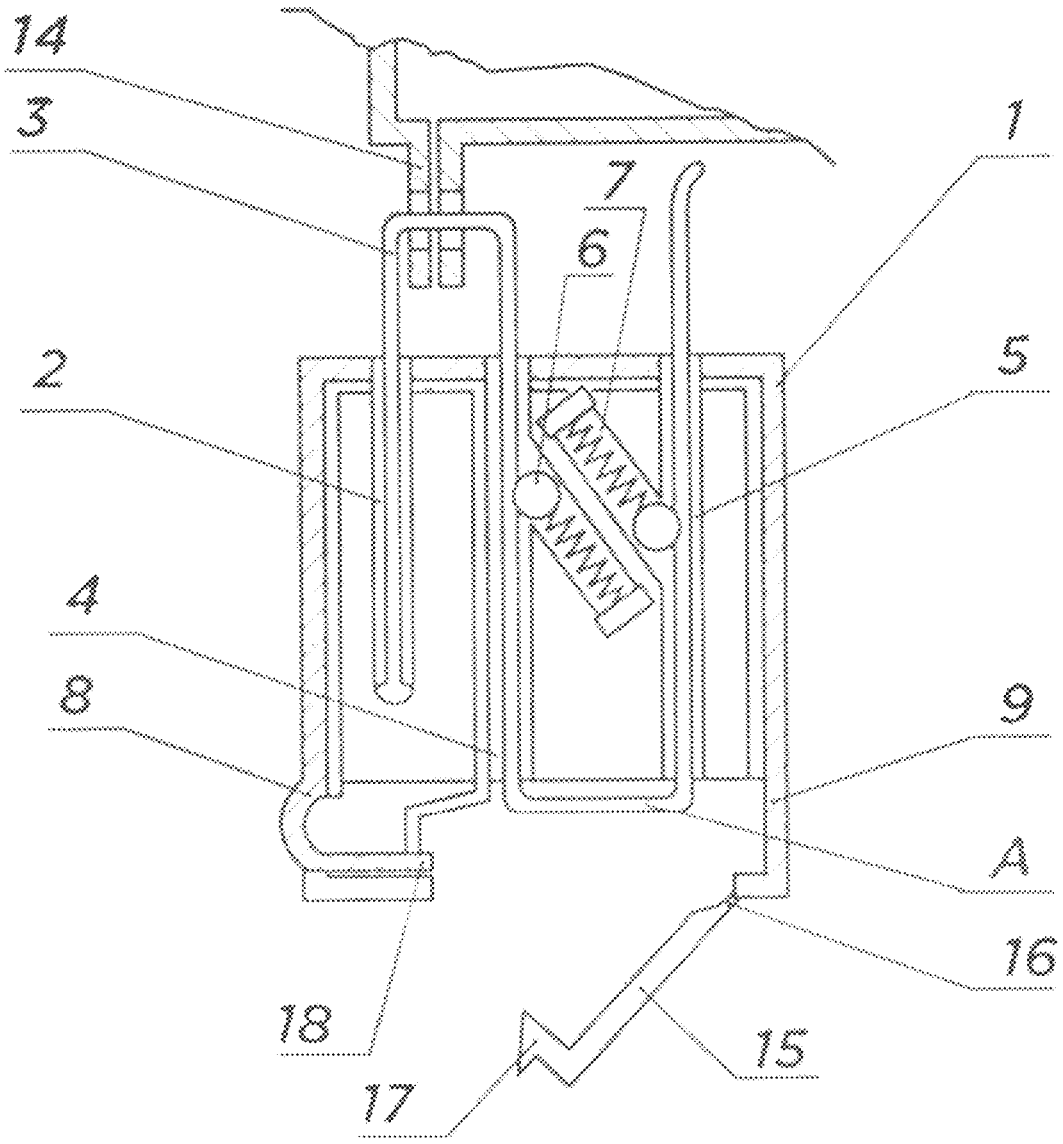

The cable seal (FIGS. 1.1, 1.2 and 4), according to the first version, includes the housing 1, where the longitudinal blind axial channel 2 is located where the end of the cable 3 is securely fixed and two axial channels 4 and 5 with locking mechanisms 6 and 7 for the location of the cable inside of them. In the lower portion of the seal, between the axial channels 4 and 5, a loop is formed, protected by the side ledge 8 and 9 of the seal. In the lower portion of the housing 1 of the seal a mechanism is mounted blocking the access to the loop A consisting of the transverse channels made on the side ledge of the seal, where a sliding bolt 10 with the blocking elements 11 is mounted on the inner side which interlock with the ledge 12 available on the lower portion of the seal.

The locking elements 11 of the cable seal are mounted in the inner portion of the bolt 10 in the form of elastic arms in an indefinite number, arranged symmetrically, in the form of a fish bone.

In addition, the blocking elements 11 of the cable seal (FIGS. 2.1, 2.2 and 5) can be mounted in the inner portion of the bolt 10 in two elastic symmetrically arranged arms, while in the lower portion of the bolt 10 there is a ledge for the bolt 10 functioning.

The cable seal (FIGS. 3.1, 3.2 and 6), according to the second version, includes a housing 1 with a longitudinal blind axial channel 2, where the end of the cable 3 is securely fixed and two axial channels 4 and 5 with locking mechanisms 6 and 7 for the location of the cable 3 inside of them; however, in the lower portion of the seal, between the axial channels 4 and 5 there is a loop A protected by the side ledge 8 and 9 of the seal. In the lower portion of the housing 1 of the seal a mechanism for blocking the access to the loop A is mounted, consisting of a covering plate 15, the end of which is pivoted 16 by the side ledge 9, while on the other end of the cover plate 15 there is a mechanism for blocking the access to the loop A, consisting of an elastic element 17 with a catch 18, connected to the ledge 8, located at the bottom of the seal.

The protection method using a cable seal (FIGS. 1.1, 1.2 and 4), according to the first version, consists of a secure fastening of the end of the cable 3 in the longitudinal blind axial channel 2 of the seal and the second end of the cable 3 is extended through the lugs 14 of the object to be sealed; then it is extended through the axial channels 4 and 5 with the locking mechanisms 6 and 7, forming at the bottom of the seal, between the axial channels, the loop A. Blocking the only access to the loop A of the cable 3 of the seal from an external influence and unauthorized opening is performed by pressing the stretched bolt 10, which, sliding along the transverse channels available on the side ledge of the seal, with its blocking elements 11 mounted on the inner portion, interlocking with the ledge 12 available on the bottom of the seal, are fixed, leaving no option for subsequent unlocking of the bolt 10.

The protection method using a cable seal (FIGS. 2.1, 2.2 and 5) consists in a secure fastening of the end of the cable 3 into the longitudinal blind axial channel 2 of the seal, while the second end of the cable 3 is extended through the lugs 14 of the object to be sealed; then it is extended through the axial channels 4 and 5 with locking mechanisms 6 and 7, forming at the bottom of the seal, between the axial channels 4 and 5, a loop protected by the side ledges 8 and 9 of the seal. The locking mechanisms 6 and 7 do not allow to pull out the cable 3 by means of an external action or unauthorized opening. Blocking the only access to the loop A of the cable 3 of the seal is performed by the action over the ledge 13 available in the lower portion of the bolt 10, which, sliding by its locking elements 11 mounted on the inner portion, block the bolt 10, leaving no option of its subsequent unblocking.

The method related to the use of a cable seal (FIGS. 3.1, 3.2 and 6), according to the second version, consists in a secure fastening of the end of the cable 3 in the longitudinal blind axial channel 2 of the seal while the second end of the cable 3 is extended through the lugs 14 of the object to be sealed and then it is extended through the axial channels 4 and 5 with locking mechanisms 6 and 7, forming at the bottom of the seal, between the axial channels 4 and 5, the loop A, protected by side ledges 8 and 9 of the seal. Blocking the only access to the loop of the cable 3 of the seal from an external action and unauthorized opening is performed by the impact on the covering plate 10 until the bolt 12 of the covering plate 10 is not connected to the ledge 13 of the locking mechanism of the loop A access.

This cable seal will provide an increased protection of the sealed property and protect against an access in housing of external action and unauthorized opening, not allowing the impact with sharp objects over the loop A of the cable which is formed between the two channels where the locking mechanisms of the sealing device are located.

What is claimed is:

1. A lock-in cable seal for sealing an object, the lock-in cable seal comprising:

a housing having a longitudinal blind channel, and first and second longitudinal through channels, the first and second longitudinal through channels being parallel to one another, the housing defining an upper portion and a lower portion;

a first locking mechanism and a second locking mechanism located in the upper portion of the housing, wherein the first locking mechanism is coupled to the first longitudinal through channel and the second locking mechanism is coupled to the second longitudinal through channel, and wherein each of the first and second locking mechanisms are aligned in an angled orientation with respect to the corresponding one of the first and second longitudinal through channels, and the first and second locking mechanisms are located parallel to each other;

a cable having an end portion, the end portion securely fastened within the longitudinal blind channel, another portion of the cable is placed in the first and second longitudinal through channels and securely fastened via the first locking mechanism and the second locking mechanism, such that the cable forms a first loop for sealing the object with the object being provided in a location exterior to the housing and between the longitudinal blind channel and the first longitudinal through channel, and the cable forms a second loop along the lower portion of the housing and between the first and second longitudinal through channels;

end ledge provided along inner walls of the lower portion of the housing, the end ledges form a longitudinal groove, with each end ledge formed at L-shaped side walls of the lower portion of the housing, wherein one of the side walls is provided with a hole;

and a third locking mechanism for blocking access to the second loop, the third locking mechanism having:

a bolt, and a locking mechanism provided with ribs on the bolt to couple with ribs provided on the lower portion of the housing, the bolt configured to slide inside the longitudinal groove of the lower portion of the housing, and blocking a gap formed between the ends of the side walls, thereby blocking access to the second loop.

2. The lock-in cable seal as claimed in claim 1, wherein the ribs on the bolt of the third locking mechanism are made of an elastic material and the number of ribs is of an amount of not less than two.

3. The lock-in cable seal as claimed in claim 1, wherein the bolt having a lower portion, the lower portion has a ledge.

4. A cable seal for sealing an object, the cable seal comprising:

a housing having a longitudinal blind channel, and first and second longitudinal through channels, the first and second longitudinal through channels being parallel to one another, the housing defining an upper portion and a lower portion;

a first locking mechanism and a second locking mechanism located in the upper portion of the housing, wherein the first locking mechanism is coupled to the first longitudinal through channel and the second locking mechanism is coupled to the second longitudinal through channel, and wherein each of the first and second locking mechanisms is aligned in an angled orientation with respect to the corresponding one of the first and second longitudinal through channels, and the first and second locking mechanisms are located parallel to each other;

a cable having an end portion, the end portion securely fastened within the longitudinal blind channel, another portion of the cable placed in the first and second longitudinal through channels and securely fastened via the first locking mechanism and the second locking mechanism, such that the cable forms a first loop for sealing the object, with the object being provided in a location exterior to the housing and between the longitudinal blind channel and the first longitudinal through channel, and the cable forms a second loop along the lower portion of the housing and between the first and second longitudinal through channels;

first and second end ledges are provided along inner walls of the lower portion of the housing, the first and second end ledges form a longitudinal groove, with each of the first and second end ledges formed at L-shaped side walls of the lower portion of the housing;

and a third locking mechanism for blocking access to the second loop, the third locking mechanism comprising:

a cover hingedly fixed at an end portion of the first end ledge, and includes an elastic catch formed on the cover, and a coupling element mounted on an end portion of the second end ledge for interlocking with the elastic catch of the cover.

5. A method for sealing an object via a lock-in cable seal the lock-in cable seal having a cable defining first and second ends; a housing having a longitudinal blind channel, and first and second longitudinal through channels; a first locking mechanism; a second locking mechanism; and a third locking mechanism including a bolt and a locking mechanism, wherein the first locking mechanism is coupled to the first longitudinal through channel and the second locking mechanism is coupled to the second longitudinal through channel and wherein each of the first and second locking mechanisms is aligned in an angled orientation with respect to the corresponding one of the first and second longitudinal through channels, and the first and second locking mechanism are located parallel to each other, the method comprising:

securely fastening the first end of the cable in the longitudinal blind channel;

extending the second end of the cable through lugs of the object to be sealed and through both of the first and second longitudinal through channels, in which the second end of the cable is fixed by the first and second locking mechanisms;

and blocking access to a first loop of the cable formed between the first and second longitudinal through channels by the third locking mechanism, wherein blocking access to the first loop comprises:

affecting the bolt by sliding the bolt inside a longitudinal groove of the lower portion of the housing until ribs provided on the lower portion of the housing couples with ribs of the locking mechanism.

6. A method for sealing an object via a cable seal, the cable seal having a cable defining first and second ends; a housing having a longitudinal blind channel, and first and second longitudinal through channels; a first locking mechanism; a second locking mechanism; and a third locking mechanism including a cover and a coupling element, wherein the first locking mechanism is coupled to the first longitudinal through channel and the second locking mechanism is coupled to the second longitudinal through channel, and wherein each of the first and second locking mechanisms is aligned in an angled orientation with respect to the corresponding one of the first and second longitudinal through channels, and the first and second locking mechanisms are located parallel to each other, the method comprising:

securely fastening the first end of the cable in the longitudinal blind channel;

extending the second end of the cable through lugs of the object to be sealed and through both of the first and second longitudinal through channels, and in which the second end of the cable is fixed by the first and second locking mechanisms;

and blocking access to a first loop of the cable formed between the first and second longitudinal through channels by the third locking mechanism, wherein blocking access to the first loop comprises:

pressing the cover until a catch of the cover is coupled with the coupling element, providing a non-detachable coupling and closing a gap formed between ends of side walls of the housing.

* * * * *